US007632240B2

(12) United States Patent
Schmidtbleicher et al.

(10) Patent No.: US 7,632,240 B2
(45) Date of Patent: Dec. 15, 2009

(54) TRAINING/FITNESS DEVICE HAVING AN OPERATING AND FUNCTIONAL UNIT

(75) Inventors: Dietmar Schmidtbleicher, Bad Homburg (DE); Christian Haas, Frankfurt (DE); Peter Kühn, Lörrach (DE); Wolfgang Häussel, Lörrach (DE); Georg Disch, Rheinfelden (DE)

(73) Assignee: Romert GmbH, Rheinfelden (DE)

( * ) Notice: Subject to any disclaimer, the term of this patent is extended or adjusted under 35 U.S.C. 154(b) by 687 days.

(21) Appl. No.: 10/516,996

(22) PCT Filed: Jun. 5, 2003

(86) PCT No.: PCT/EP03/05908

§ 371 (c)(1),
(2), (4) Date: Mar. 1, 2005

(87) PCT Pub. No.: WO03/103858

PCT Pub. Date: Dec. 18, 2003

(65) Prior Publication Data

US 2005/0115353 A1 Jun. 2, 2005

(30) Foreign Application Priority Data

Jun. 6, 2002 (DE) ..... 102 25 323

(51) Int. Cl.

| | |
|---|---|
| ***A61H 1/00*** | (2006.01) |
| ***A61H 23/02*** | (2006.01) |
| ***A63B 22/14*** | (2006.01) |
| ***A63B 22/16*** | (2006.01) |

(52) U.S. Cl. ..... 601/29; 601/31; 601/35; 601/87; 601/90; 601/93; 601/98; 601/101; 482/51; 482/146

(58) Field of Classification Search ..... 601/46, 601/49, 50, 51, 53, 61, 27, 29, 31, 32, 33, 601/34, 35, 86, 87, 90, 93, 98, 101; 482/54, 482/146, 147, 51

See application file for complete search history.

(56) References Cited

U.S. PATENT DOCUMENTS

| | | | | |
|---|---|---|---|---|
| 1,279,138 A | | 9/1918 | Nicoll | |
| 1,565,484 A | * | 12/1925 | McWhirter | 482/146 |
| 2,206,902 A | * | 7/1940 | Kost | 601/27 |
| 5,755,652 A | * | 5/1998 | Gardner | 482/146 |

FOREIGN PATENT DOCUMENTS

| | | |
|---|---|---|
| DE | 328563 | 10/1920 |
| DE | 37 33795 A1 | 4/1989 |

* cited by examiner

*Primary Examiner*—Danton DeMille
(74) *Attorney, Agent, or Firm*—The Nath Law Group; Jerald L. Meyer; Robert T. Burns

(57) ABSTRACT

The invention relates to a device comprising two table-like supporting plates, which serve as operating and functional units. The supporting plates each have a longitudinal and transversal extension, are arranged parallel to one another in a frame that can be immobilized in a fixed manner, and are each mounted so that they can spatially move with three-dimensional degrees of freedom that are independent of one another. In addition, a motor-operated drive is provided that can set the supporting plates in oscillatory motion at least in a one-dimensional direction and independent of one another.

12 Claims, 14 Drawing Sheets

TRAINING/FITNESS DEVICE HAVING AN OPERATING AND FUNCTIONAL UNIT

The invention relates to a device that is provided with a two-part operating and functional unit which is designed as a pedestal- or table-like unit. According to the invention, the device comprises a frame that can be stationarily fixed in place and having two table-like supporting plates, located next to one another, which are situated parallel to one another in this frame. These table-like supporting plates are each mounted separately and independent of one another so as to be movable in three dimensions. At least one motorized drive is provided which sets the table-like supporting plates in randomized, oscillating-pulsating motion in at least one dimension, independent of one another. These motions describe an elliptical or circular trajectory whose amplitudes may be different. The particular frequency of these motions can be modified.

The invention provides that each of the two table-like supporting plates is positioned at both its end regions on forked mountings which are movable in three dimensions and which accommodate bearings for both ends of axle shafts of eccentric rollers for each of the two table-like supporting plates. Limiting rollers are situated above the double-ended eccentric rollers. These limiting rollers have an interspace "d" around the circumference of each associated eccentric roller. The referenced eccentric rollers have a cylindrical shape and eccentric axle shafts. Each of the eccentric rollers is supported on one drive roller and one support roller. The drive rollers cause the eccentric rollers to move in a rotary motion, in the same or opposite direction, synchronously or asynchronously. As a result of the eccentric bearing of the axis shafts in forked mountings which are movable in three dimensions, the axis shafts are set in motion dependent on the rotational speed and describing elliptical or circular trajectories.

These motions act on the supporting plates which are connected to the forked mountings. The limiting rollers situated above the eccentric rollers are responsible for limiting the oscillations of the eccentric rollers when the latter, on account of their eccentric bearing, are lifted up from their support position under the influence of centrifugal force.

The referenced drive rollers are mounted in side walls of the frame, and are set in synchronous rotational motion in the same direction by at least one motorized drive. In an alternative to this design, the drive rollers are set in synchronous or asynchronous rotational motion in opposite directions.

Further essential features of the invention lie in the fact that each of the two table-like supporting plates is positioned at both its end regions on the respective associated forked mountings. These mountings may also have other designs that are not forked, and are provided with bearings for the double-ended axle shafts of the eccentric rollers. Pads made of a resilient material, or articulated joints, may be inserted between the forked mountings and the table-like supporting plate so as to provide capability for tilting in the transverse direction; however, a rigid connection may also be provided so that there is no capability for tilting in the transverse direction at the affected site.

An alternative design also provides that on each of the two table-like supporting plates longitudinal tilting axles extending in the x axis are present on which the cover plates are tiltably linked by connecting pieces. Instead of these longitudinal axles, longitudinal hinges may also be provided by which the supporting plates may be tiltably connected.

Essential features of the invention lie in the fact that the table-like supporting plates are mounted so as to be movable in three dimensions. To drive the device, it is sufficient to have at least one drive motor which sets one or more components of the unit in oscillatory motion in at least one dimension. The frequency of these oscillatory motions may be modified within certain limits. Furthermore, the amplitudes of the oscillatory motion may also be modified within certain limits.

The device may be used for various purposes and applications in which it is important for objects, materials, or substrates to be acted on by rhythmical or arrhythmical mechanical impacts or vibrations. Thus, for large-particle bulk materials, separating or sorting processes can be initiated or performed, or for fine-particle or powdered bulk materials mixing or homogenizing procedures can be carried out. When the two-sided supporting plates or the cover plates joined to same are connected to one another by a rigid or resilient element by means of articulated connections, these impactive or oscillatory effects can produce a sequence of pulsating and divergent, irregular or randomized motions for these elements that are independent of one another.

The device may also be used as training/fitness equipment, or as a medical therapy apparatus for persons or animals, in particular to increase their coordination abilities and/or to stimulate certain muscles.

One interesting area of application in particular is the loosening and relaxation of the musculature of high-performance athletes, especially ski jumpers and downhill racers. A further interesting area of application is the stimulation of the muscles of persons with Parkinson's disease. It has been shown that symptoms such as stiffness or tremors may be beneficially affected.

It has proven to be particularly advantageous for the table-like supporting plates to have an amplitude of approximately 3 mm at a frequency of 1-20 Hz, preferably 4-6 Hz.

The device may additionally be used to address various problems in different fields. When objects, materials, or substrates are subjected to the referenced rhythmical or arrhythmical, impactive or oscillatory effects, it is possible to produce the various changes described above, such as effects on the crystalline structures of solid materials.

According to further features, the device may be provided with at least one fastening device for the detachable, impact- and vibration-free connection of a receptacle for a vessel or mounting. The attachable vessel may be used for receiving free-flowing material provided for processing; by use of the mounting, solids or similar materials for processing may be connected to the device in an impact- and vibration-free manner. The fastening device may comprise a receptacle that includes a shoe, mounted on the supporting plate or cover plate, which is used to securely place or insert the object to be fastened. The fastening device may also include belts and/or straps with buckles, or it may be provided with support mountings with adjustable clips.

These fastening devices, in particular belts and/or straps with buckles, may be used to secure human or animal limbs. A device with fastening devices having such a design is particularly suited as training/fitness equipment or a therapy device of the type described above.

In one particular embodiment of this device having the latter referenced type of design, according to the invention seating and/or supporting capability is provided to provide the particular persons with stability while the device is operating.

Exemplary embodiments of the invention are schematically illustrated in the drawings listed below, and are described in greater detail below.

Figure 4:
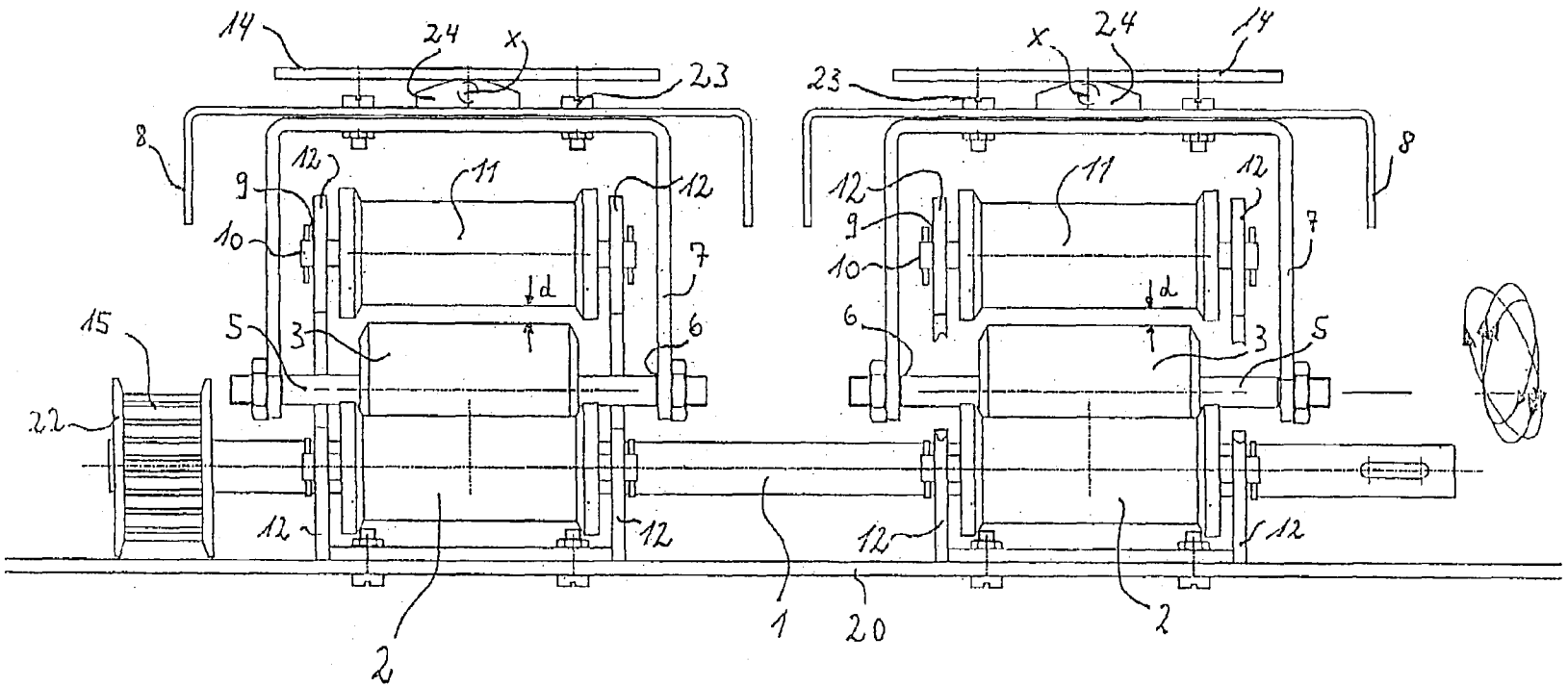
FIG. 4 shows a cross section with both halves of the device.
Figure 11C:
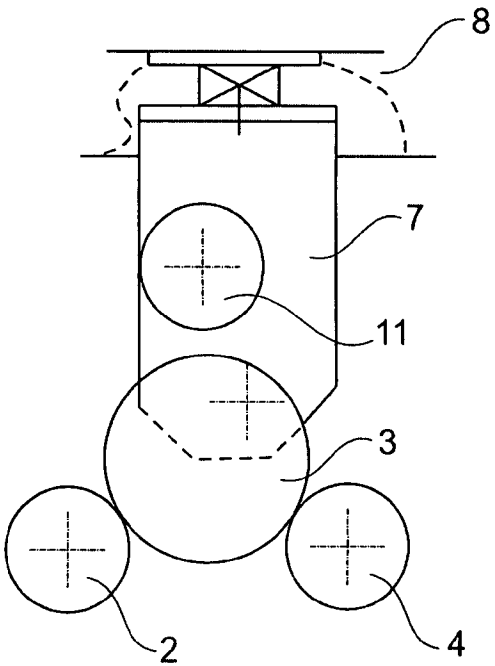
Figure 11B:
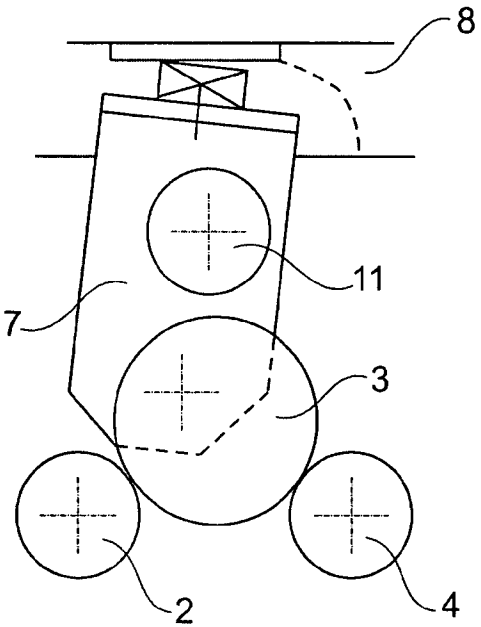
Figure 11A:
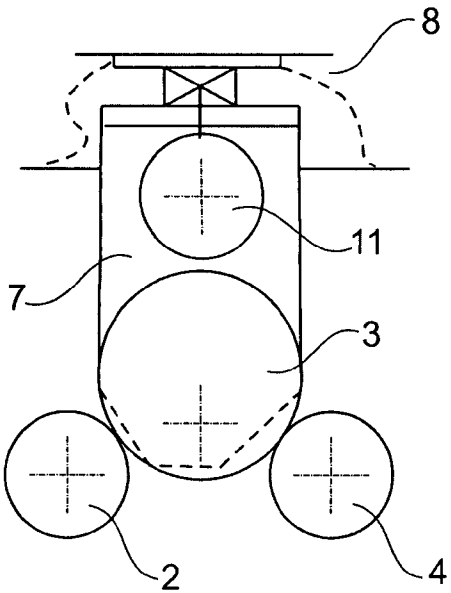
Figure 12:
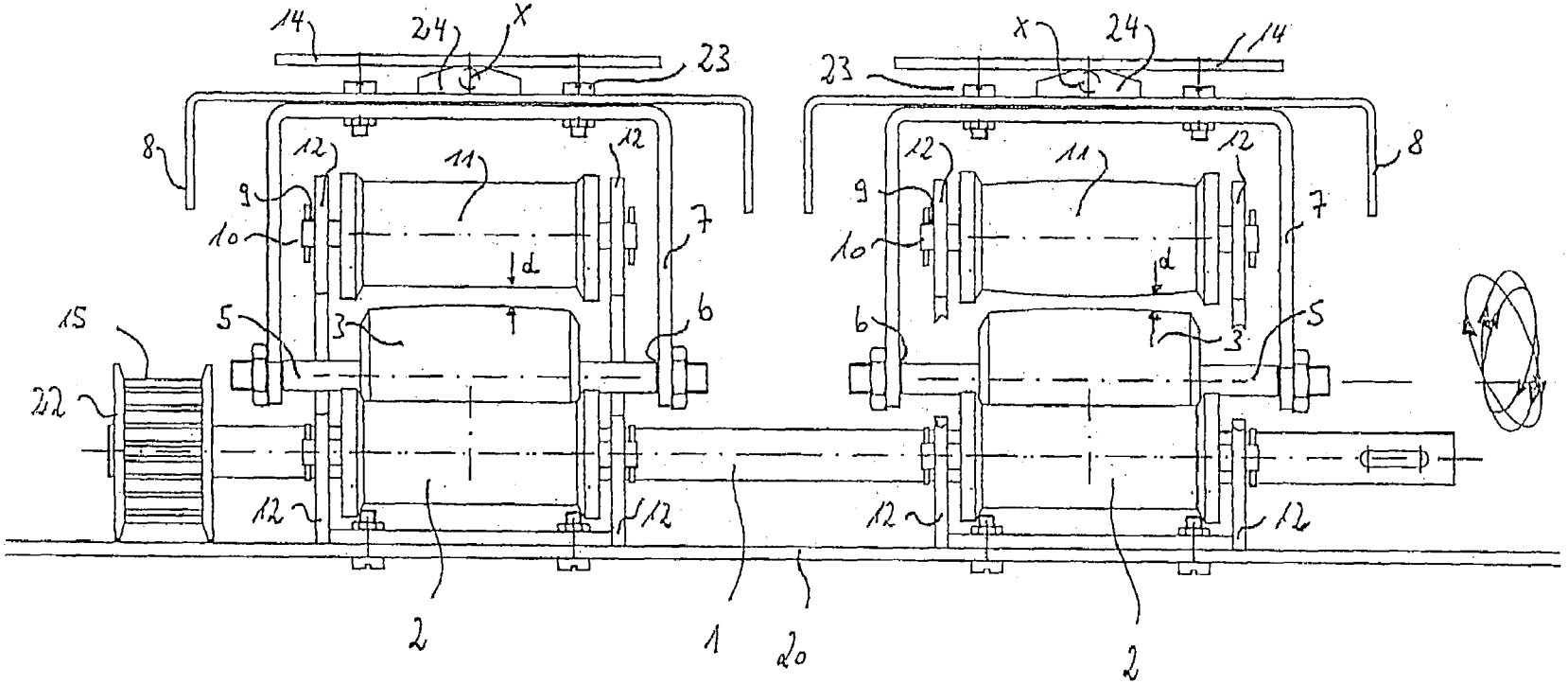
Figure 13:
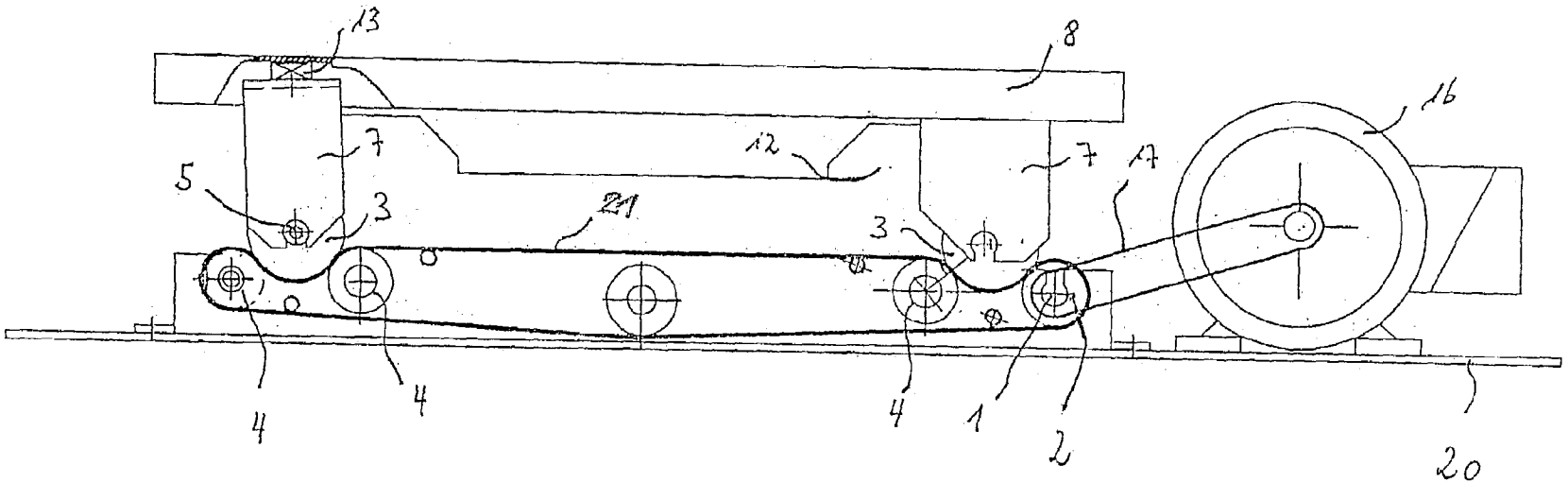
Figure 14:
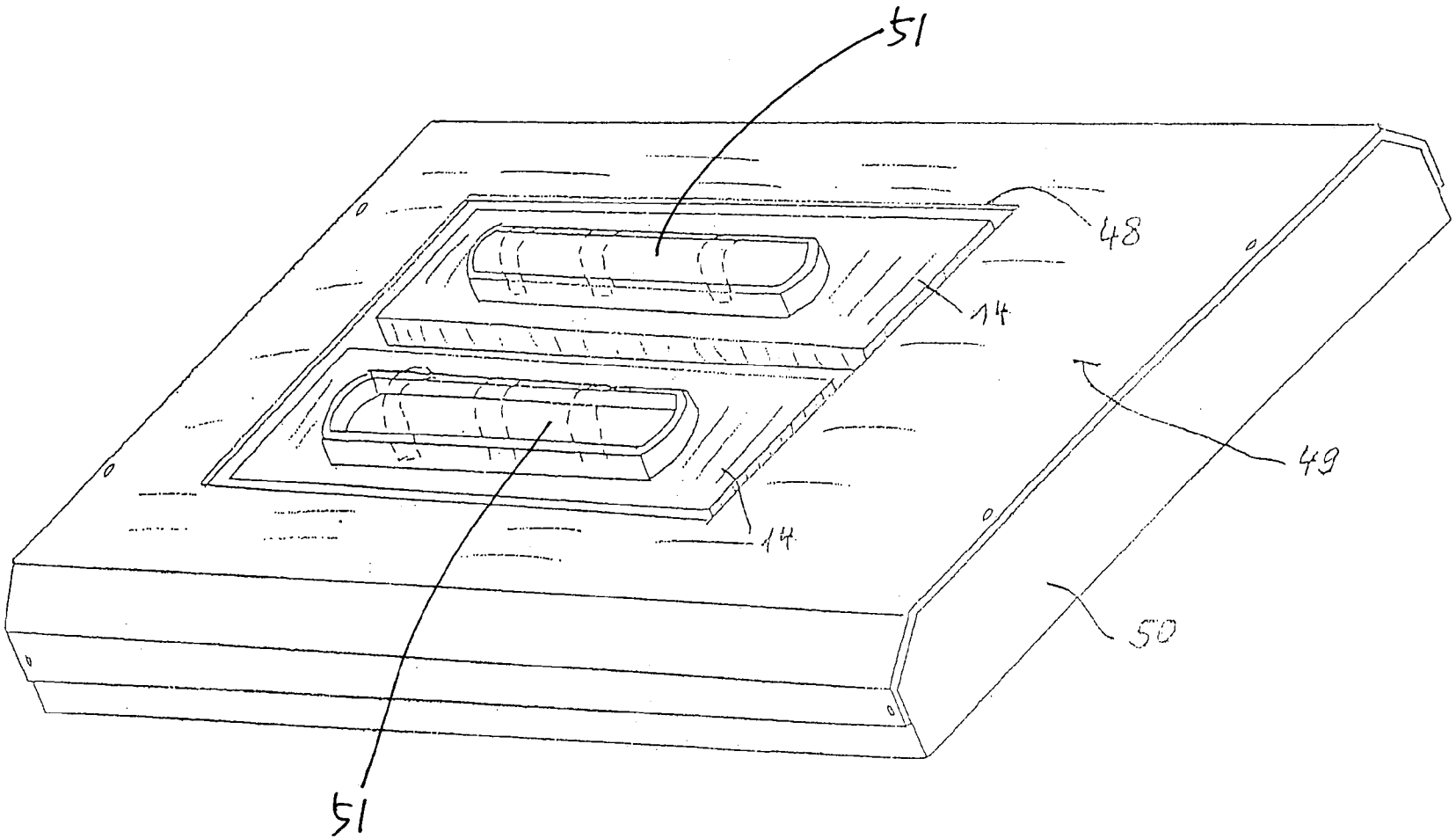

FIG. 11 *a*) through *c*) shows three schematic illustrations of the possible motions of the device;

FIG. 12 shows an alternative device according to FIG. 4;

FIG. 13 shows a side view of the device without a cover, in an alternative design; and FIG. 14 shows an illustration of the device with a complete cover.

Figure 1:
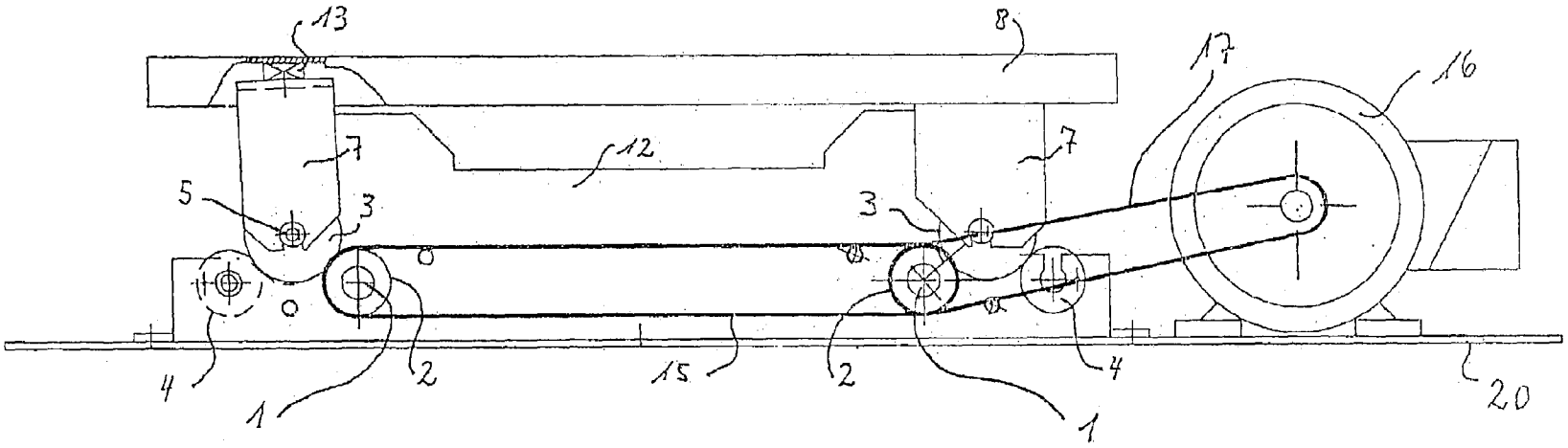
FIG. 1 shows a side view of the device without a cover.

The device is illustrated in the side view without a cover in FIG. 1. The device has two drive shafts 1 running transverse to the longitudinal direction which are separated from one another in their longitudinal direction, and which are synchronously driven in the same rotational direction by a motorized drive 16/17 comprising a drive motor 16 and drive belts 17. Each of the two drive shafts 1 running in the transverse direction bears a drive roller 2 on each of its two ends. The two drive shafts 1 are synchronously connected to one another in the same rotational direction by a toothed belt connection 15.

Figure 2:
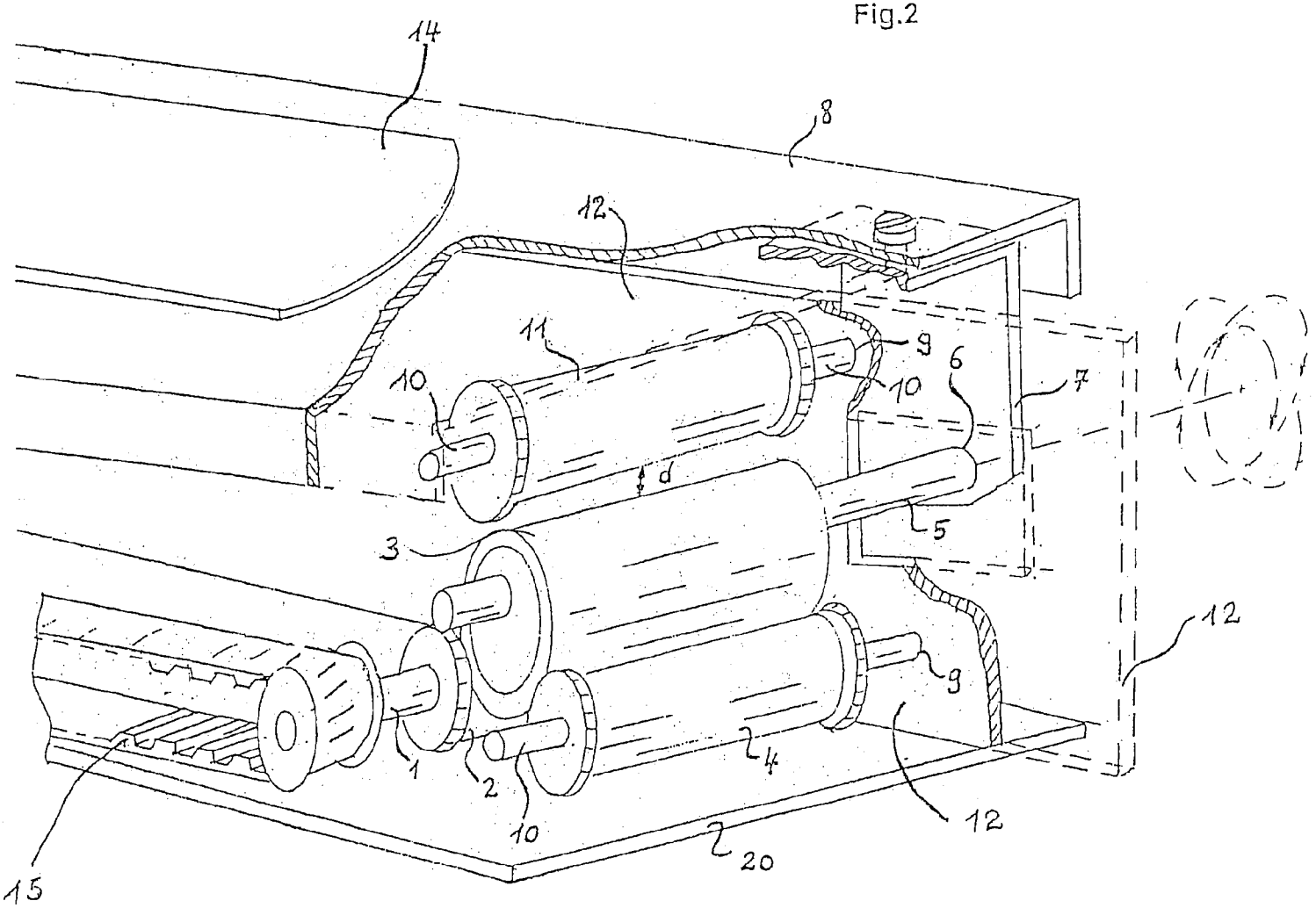
FIG. 2 shows a partial section through the mechanical moving part of one of the two halves of the device.

The right side of the system depicted in FIG. 1 is illustrated in FIG. 2. The corresponding side of the drive shaft 1 and the drive roller 2 situated thereon can also be seen. The eccentric roller 3, which is supported so as to roll out on the drive roller 2 as well as a support roller 4, is also evident in FIG. 2. It can be seen in FIG. 2 that the eccentric roller 3 has an eccentric axle shaft 5. As a result of the rotation of the eccentric roller 3, with each revolution the axle shaft 5 of the eccentric roller performs a motion, in at least the magnitude of the eccentricity, describing an oscillatory, ellipsoidal, or circular path. This motion, referred to below as ellipsoidal motion, is composed of a simultaneous vertical and horizontal motion which is transmitted to the bearings 6 of the axle shaft 5. This bearing 6 is installed in a forked mounting 7. The forked mounting 7 thereby likewise experiences a repetitive oscillating motion, referred to as ellipsoidal motion, which is directed vertically and horizontally. Reference number 12 denotes a side wall which is rigidly mounted and securely joined to the frame 20.

The bearings 9 for bearing the axle journals 10 for the support roller 4 and the limiting roller 11 are situated in this side wall 12.

Duration rotation, due to the centrifugal forces which occur the eccentric roller 3 may lift up from the drive roller 2 and the support roller 4 on which the eccentric roller 3 rests. This lifting is not detrimental, and in fact is even desirable under certain conditions. In this manner the uniformity of the rotational motions of the eccentric roller 3 is interrupted for fractions of a second, thereby irregularly modifying the rotational speed of the eccentric roller, as desired, as the result of the slippage created. The limiting roller 11 is responsible for imposing an upper limit for the vertical lift displacement and lifting of the eccentric roller 3. An interspace "d" is maintained between the eccentric roller 3 and the limiting roller 11, as shown in FIG. 2. This interspace "d" also limits the maximum degree of lifting of the eccentric roller 3. The non-uniformity of the rotational motion thus produced is also transmitted to the forked mounting 7, and as the result of the mass inertia or interaction of impacts and oscillations, is transmitted to objects, persons, animals, materials, or substrates situated on the supporting plate 8 or secured to same. These effects are facilitated by the fact that the supporting plate 8 is movable or tiltable in the transverse direction as well, since the eccentric roller 3 permits sufficient clearance due to its distance "d" from the limiting roller 11.

Figure 3:
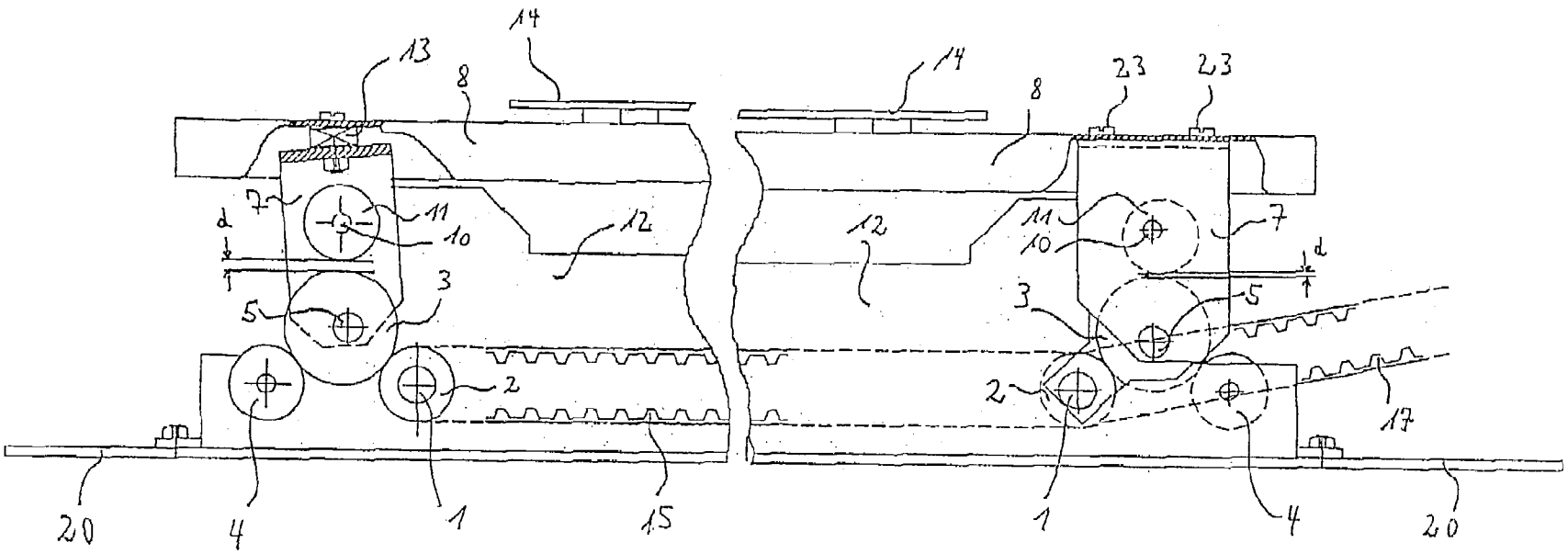
FIG. 3 shows a partial side view with partial sections.

FIG. 3 shows the device in the side view. The right side corresponds in all essential features to the illustration in FIG. 2. The illustration on the left side corresponds to the left side of FIG. 1. The referenced right side of the illustration in FIG. 3 shows the same features and elements of FIG. 2: the drive shaft is designated by reference number 1, and the drive roller is designated by 2. Here as well, the eccentric roller 3 is supported on the drive roller 2 and the support roller 4. Here the eccentric roller 3 is also borne by its axle shaft 5 in the forked mounting 7, which is designed to move in three dimensions. The interspace "d" in FIG. 3 is intentional; it is between 1 and 50 mm, and as mentioned above makes it possible for the eccentric roller to lift up and allows the impacts and oscillations of the eccentric roller 3, depending on the particular instantaneous distance "d," to be transmitted to the forked mounting 7 with varying intensities and in different time intervals (and thus in variable frequencies), as intended.

As can be seen from the illustration on the left side of FIG. 3, the forked mounting 7 which is movable in three dimensions bears on its upper flattened end at least one pad 13 made of an elastic, resilient material. The supporting plate 8 is supported on this pad 13, and as a result of this mounting is tiltable within certain limits on account of the additional degree of freedom thus provided in the direction transverse to the longitudinal extension of the device. Furthermore, the pad(s) 13 are used to absorb the longitudinal displacement that is transmitted from the forked mounting 7 to the supporting plate 8. An articulated joint may also be used instead of the pad 13.

As an alternative to the embodiment described above, the comparative design of the right illustration in FIG. 3 is not provided with a pad 13. Instead, the supporting plate 8 connected to the forked mounting 7 which is movable in three dimensions is not able to tilt in the transverse direction at this location, since the supporting plate 8 (see FIG. 3) is rigidly connected to the forked mounting 7 by threaded connections 23. Nevertheless, a tilting motion of the supporting plate 8, which is screwed to the forked mounting 7, in the transverse direction is very well possible and is intended, since the eccentric roller 3, as described above, permits a corresponding degree of freedom due to its distance "d" from the limiting roller 1.

It is within the scope of the invention to connect these supporting plates 8 at both their end regions to the forked mountings 7 by means of at least one resilient pad 13 or at least one articulated joint 13.

FIG. 3 also shows a design on the right side that is a mirror image of all the features of the design on the left side. The mirror-image corresponding features are therefore provided with matching reference numbers. Here as well, the drive shaft is designated by reference number 1, and the drive roller is designated by 2. The eccentric roller 3 is also supported here on the drive roller 2 and the support roller 4. Here as well, the limiting roller 11 is situated above the eccentric roller 3 while maintaining the distance "d."

Furthermore, the motorized drive for the device is partially visible in FIG. 3. A drive motor, not shown, drives the drive shaft 1 by means of a toothed belt connection 17. The respective right and left sides of the drive rollers 2 are each connected by the toothed belt 15, and are thus driven synchronously in the same direction. The frame on which the side wall 12 is fastened is designated by reference number 20 in FIG. 3. One alternative, not shown, involves driving the drive rollers 2 in the same direction but asynchronously, or synchronously in opposite directions, or asynchronously in opposite directions, using one or more motors.

FIG. 4 shows a cross section through the device. The common drive shaft 1 for both sectional designs, which are situated adjacent and parallel to one another and which are fastened to the frame 20 one behind the other in the longitudinal direction of the device, can be seen here. A drive roller 2 rests on each of the drive shafts 1 of the two adjacently situated sectional designs. The eccentric rollers 3 are supported on this drive roller and on support rollers 4, not shown (see FIGS. 1 through 3). On each end these eccentric rollers have eccentric axle shafts 5 which are held in the forked mountings 7 in the bearings 6. The impacts and oscillations of the axle shafts 5 are thus transmitted to these forked mountings 7 which are movable in three dimensions, and set the latter in ellipsoidal motion. The limiting rollers 11 located thereabove are borne by their axle journals 10 in the bearings 9, in the side walls 12. Tilting motions of the supporting plates 8 are also possible, since the eccentric rollers 3 have an additional degree of freedom because of their distance "d" from the limiting rollers 11. The supporting plates 8 are fastened to the forked mountings by threaded connections 23, and the tiltable bearing systems of the cover plates 14 are centrally located on these supporting plates. The cover plates are supported about the longitudinal "x" axes in the rocker bearings 24, with a limited ability to tilt. This results in an additional degree of freedom for the cover plates 14, which are movable through a limited tilt angle in the transverse direction.

Figure 5:
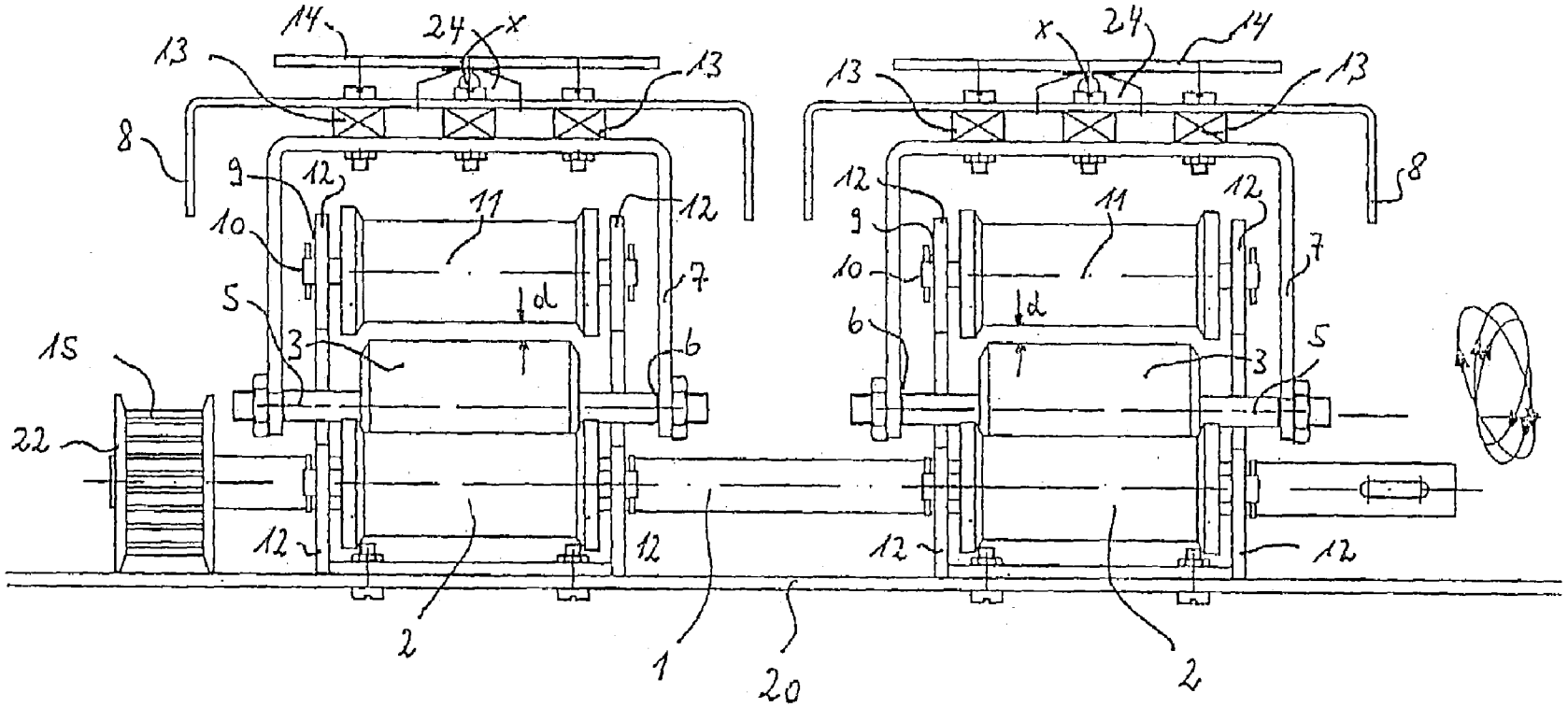
FIG. 5 shows a cross section with both halves of the device in an alternative design.

A variation of the design according to FIG. 4 is illustrated in FIG. 5. In a design that otherwise is identical to FIG. 4, here the supporting plates 8 are not rigidly connected to the forked mountings 7, but instead are connected to the mountings 7 via the pads 13 or articulated joints. The latter are used to absorb the longitudinal displacement that is transmitted from the forked mounting 7 to the supporting plate 8.

Figure 6:
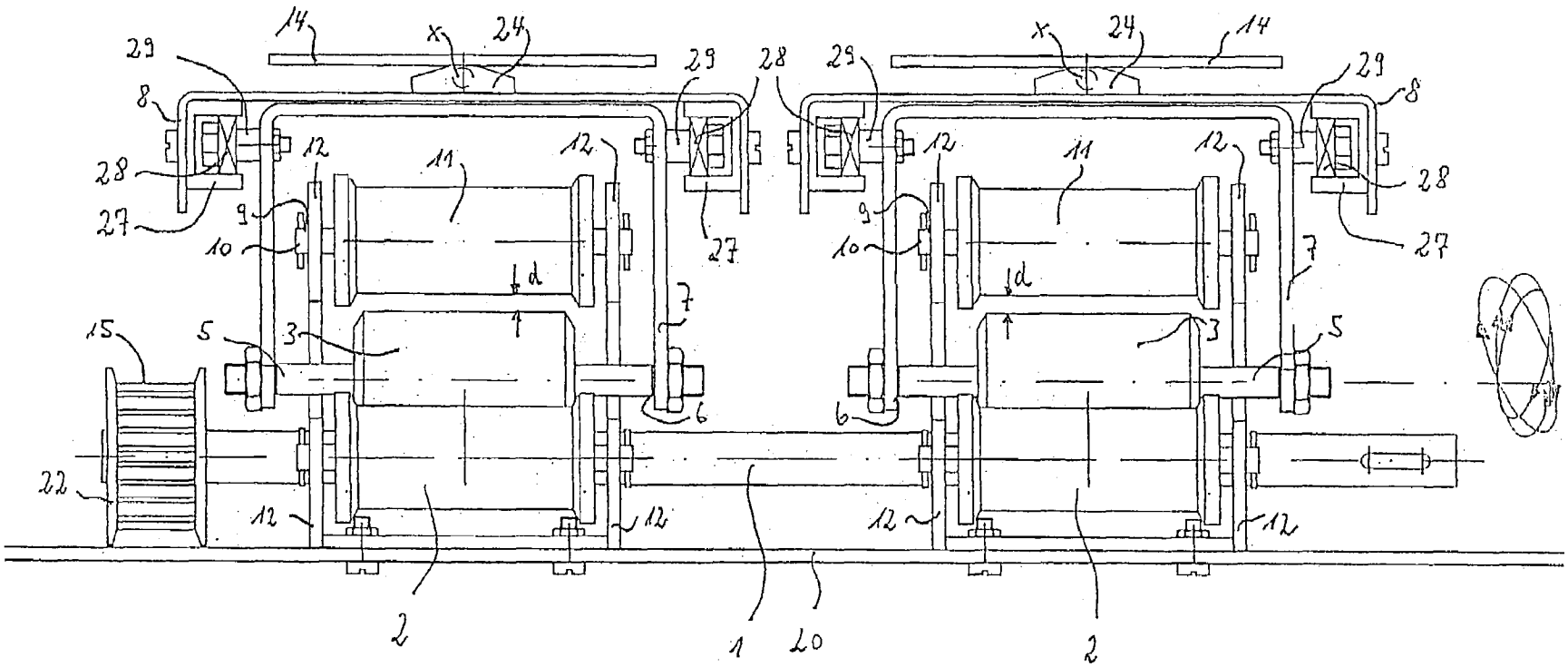
FIG. 6 shows a cross section with both halves of the device in a further alternative design.

An additional alternative design can be seen in FIG. 6. Here, the supporting plates 8 are provided on each end with U-shaped longitudinal tracks 27 whose U openings point inward, and in which rollers or roller bearings 28 are guided which are connected by bearing journals 29 to the forked mountings 7. This track connection is used to absorb the longitudinal displacement that is transmitted from the forked mounting 7 to the supporting plate 8.

As a result of these overall device features, the device is designed so that the two adjacently situated supporting plates 8 can perform limited ellipsoidal motions in the vertical and horizontal directions, and the cover plates 14 connected to the supporting plates 8 likewise can perform ellipsoidal motions in the vertical and horizontal directions as well as tilting motions about longitudinal "x" axes, and that, independent of one another, the supporting plates and cover plates are set in impactive or oscillatory ellipsoidal motions of different frequencies. The ellipsoidal motions may be different in form. Also, the corresponding degree of freedom is additionally tiltable by "d" from the eccentric roller 3 to the limiting roller 11.

Figure 7:
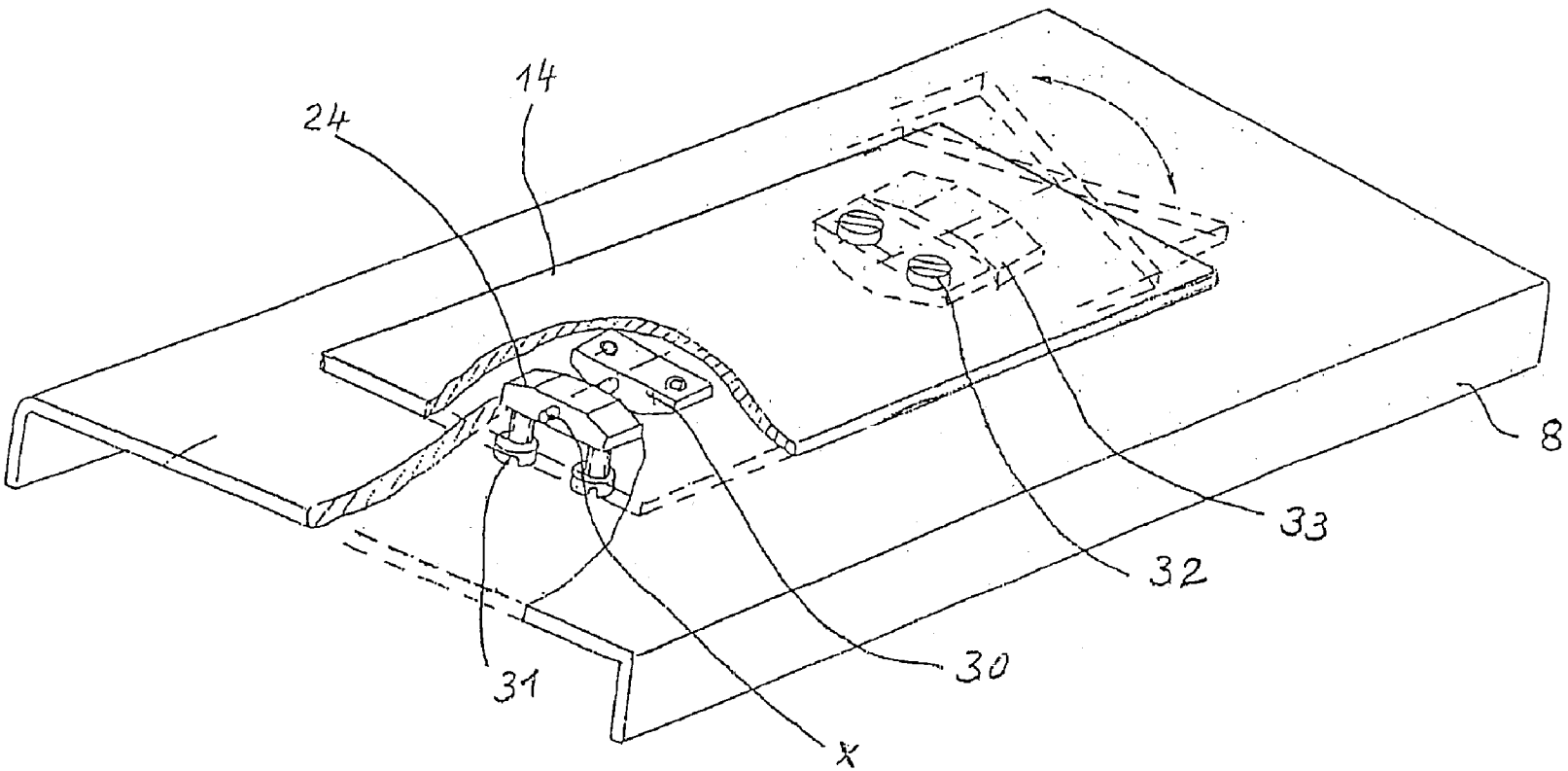
FIG. 7 shows a partial side view with partial sections on the supporting plate and the cover plate.

FIG. 7 shows the alternative designs, illustrated in FIGS. 5 and 6, of the connection between one of the cover plates 14 to its associated supporting plate 8 in a side perspective view. The cover plates 14 are tiltable about the x axis as a result of the rocker bearing 24 and the rocker holder 30. The rocker bearings are joined to the supporting plate 8 by screws 31. The cover plates 14 are thus movable within narrow limits in the transverse direction, as indicated by the dashed lines.

Figure 8:
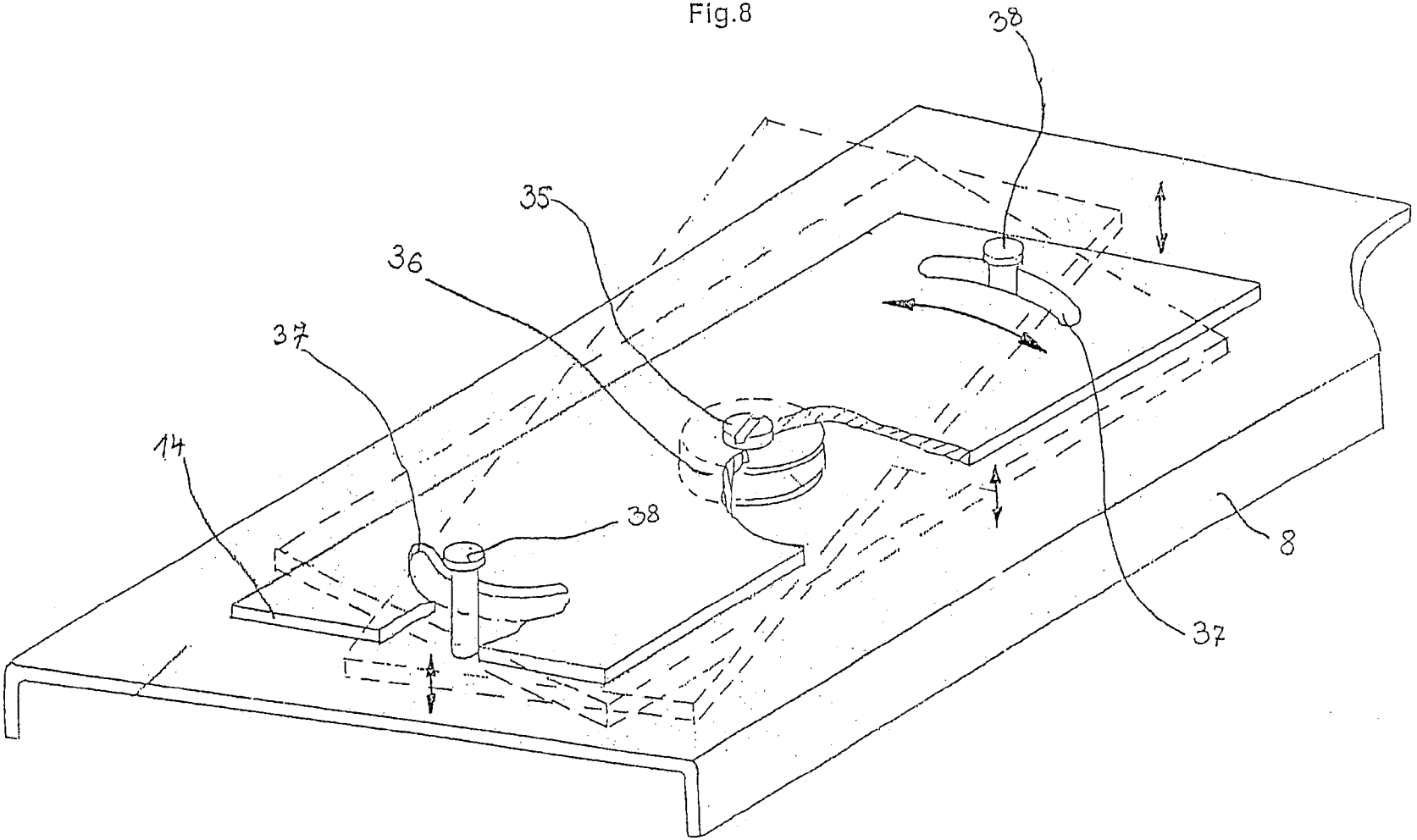
FIG. 8 shows a partial side view with partial sections on the supporting plate and the cover plate according to FIG. 7.

FIG. 8 shows an alternative design with respect to FIG. 7. Here, the cover plates 14 are able to move in three dimensions, held in the central surface area of the supporting plates 8 by screw bolts 35 on an elastic intermediate bearing disk 36. Tilting motions by the cover plates 14 in both the transverse and longitudinal directions are thus made possible. To limit these tilting motions by the cover plates 14 in both directions, sickle-shaped slits 37 are incorporated therein which are guided in stationary positioning bolts 38 and limit the range of motion of the cover plates. As a result of this mounting of the attachment in these stationary positioning bolts 38, the cover plates 14 are able to swivel about the positioning bolts and also slightly tilt in the longitudinal and transverse directions.

Figure 9:
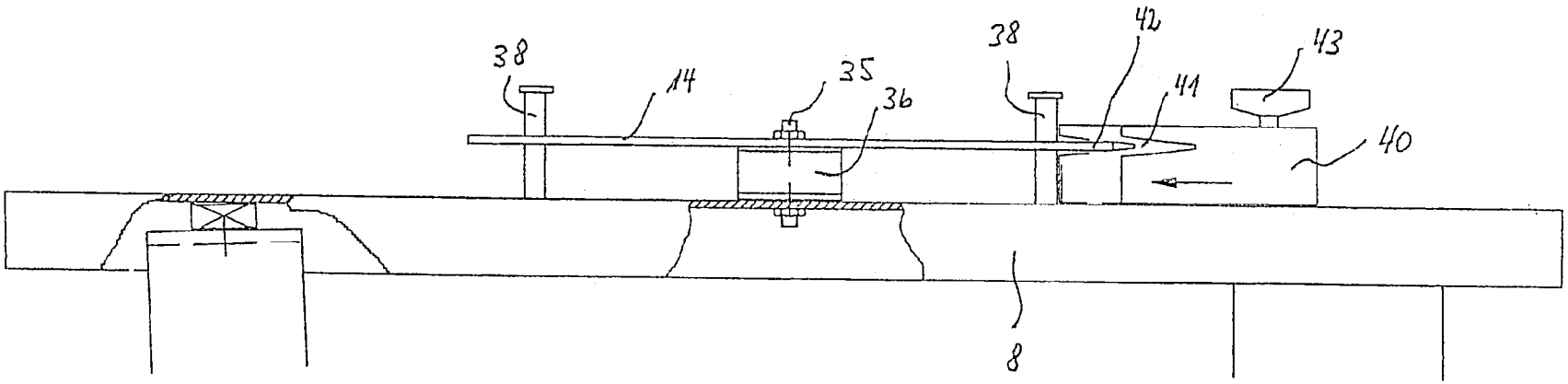
FIG. 9 shows a partial side view with partial sections on the supporting plate and the cover plate according to FIG. 8.
Figure 10:
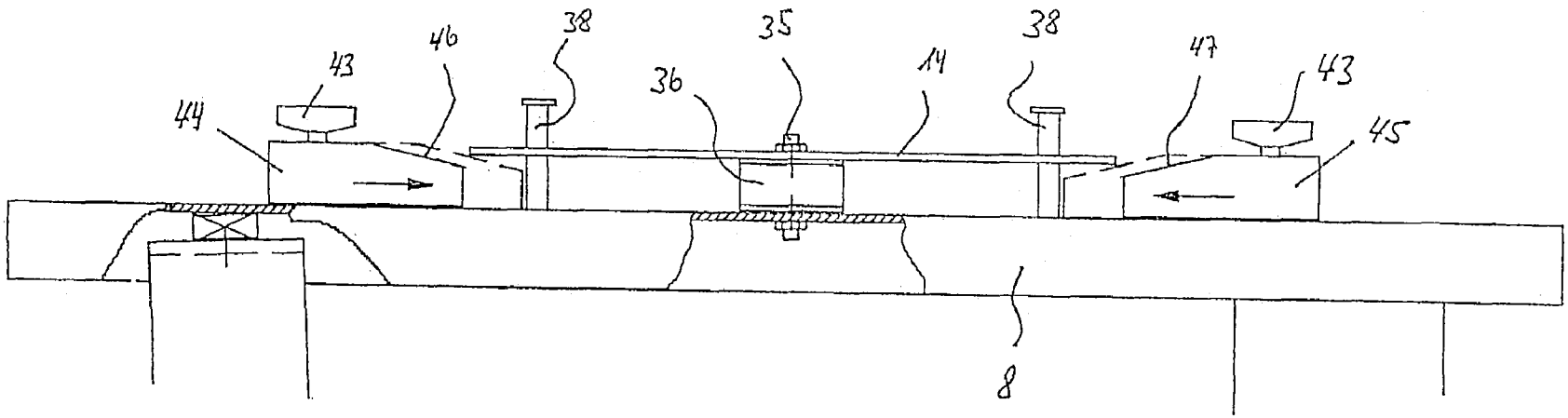
FIG. 10 shows a partial side view with partial sections on the supporting plate and the cover plate according to FIG. 8, in an alternative design.

FIGS. 9 and 10 show the designs according to FIG. 8, using additional devices which enable the motions of the cover plates 14 on the supporting plates 8 to be partially or totally limited. In FIG. 9 a slider bar having a horizontal slot is designated by reference number 40. The slider bar 40 can be pushed in the longitudinal direction until all or part of a projection 42 from the cover plate 14 is taken inside the slot 41. When the slider bar 40 is pushed all the way, the projection 42 is fixed therein, so that the cover plate 14 is fixed as well and can no longer move. If the motion of the cover plate 14 is to be only limited, the slider bar 40 is pushed only part of the way, and is held in this position by the adjusting screw 43.

A variant of this design of the total or partial limitation of motion of the cover plate 14 on the supporting plate 8 can be seen in FIG. 10. Here, two sliding pieces 44, 45 with rising, ramp-like inclined surfaces 46, 47 are provided by which the particular cover plate 14 can be totally or partially fixed in place by pushing the sliding piece forward.

FIG. 11 shows a schematic partial side view of the device according to one of FIGS. 1 through 3, illustrating three different positions a) through c) of the forked mountings 7 resulting from the eccentricity of the axle shafts 5 or eccentric rollers 3. The various ellipsoidal motions of the forked mountings 7, and thus of the supporting plates connected thereto, can be seen from these positions.

In FIG. 12 a design according to FIG. 4 can be seen, in which the eccentric roller 3 has a shell surface that is convex instead of cylindrical. The degree of convexity may be between 1.00 mm and 10.00 mm. In a further variant, the limiting roller 11 in addition to the eccentric roller 3 may also have a convex shell surface. These convex shell surfaces enable the forked mountings 7 to be influenced with respect to even greater tiltability in the transverse direction.

FIG. 13 illustrates a variant of FIG. 1. Here, the eccentric roller 3 is driven only indirectly by a drive roller 2, since the eccentric roller 3 lies on a conveyor belt 21 that is driven by a drive roller 2. Because the eccentric roller 3 lies directly on the conveyor belt 21, the eccentric roller 3 is driven by this conveyor belt. This design simplifies the drive, since in each case a special drive roller is spared. The drive train is transmitted from the drive motor 16 and the drive belt 17, over a drive roller 2 by means of a conveyor belt 21, directly to the eccentric rollers 3 lying on the conveyor belt 21.

Lastly, FIG. 14 shows the overall device with the two cover areas 14 which, situated next to one another in a cutout 48 in the top side 49 of the complete covering 50, may be externally acted on or loaded by objects or the like.

As a result of the independent motions of asynchronous, randomized ellipsoidal impacts and oscillations of the inventive device, a container or (human, animal, or other) body connected to the two supporting plates 8 or cover plates 14 may be set in extremely effective vibration.

LIST OF REFERENCE NUMBERS

1 Drive shaft
2 Drive roller
3 Eccentric roller
4 Support roller
5 Axle shaft
6 Bearing for axle shaft
7 Forked mounting
8 Supporting plate
9 Bearing for axle journal
10 Axle journal
11 Limiting roller
12 Side wall
13 Pad
14 Cover plates
15 Toothed belt connection
16 Drive motor
17 Drive belt
20 Frame
21 Conveyor belt
23 Threaded connection
24 Rocker bearing
27 Longitudinal tracks
28 Roller bearing
29 Bearing journal
30 Rocker holder
21 Screws
32 Screw connections
33 Bearing blocks
35 Screw bolts
36 Intermediate bearing disk
37 Sickle-shaped slits
38 Positioning bolt
40 Slider bar
41 Slot (in slider bar)
42 Projection from cover plate
43 Adjusting screw
44 Sliding piece I
45 Sliding piece II
46 Inclined surface I
47 Inclined surface II
48 Cutout
49 Top side of covering
50 Complete covering
51 Shoes

The invention claimed is:

1. Device comprising first and second table-like supporting plates which serve as operating and functional units, wherein the first and second table-like supporting plates each have a longitudinal and transverse extension, with the first table-like supporting plate being parallel to the second table-like supported plate in a frame that is fixed stationary in place;

at least one motorized drive sets the first and second table-like supporting plates in oscillating motion in at least one dimension; and the first and second table-like supporting plates are mounted separately and independent of one another so as to be moveable in three dimensions and the oscillating motion imposed to each plate by the motorized drive is a randomized motion, where the motions of both plates are independent of one another, characterized in that each of the first and second table-like supporting plates is positioned at both its end regions on forked mountings, each of which is movable in three dimensions and which accommodates bearings for both ends of axle shafts of eccentric rollers, and that the eccentric rollers are supported on one side by drive rollers and on the other side by support rollers, and that the double-ended drive rollers are set in synchronous or asynchronous rotational motion, in the same or different directions, by at least one motorized drive, and that above the eccentric rollers limiting rollers are situated which have a small interspace "d" with respect to the eccentric rollers.

2. Device according to claim 1, characterized in that each of the first and second table-like supporting plates is positioned at both its end regions on forked mountings, each of which is movable in three dimensions and which accommodates bearings for both ends of axle shafts of eccentric rollers, and that the eccentric rollers are supported on one side by drive rollers and on the other side by support rollers, and that the double-ended drive rollers are set in synchronous or asynchronous rotational motion, in the same or different directions, by at least one motorized drive, and that above the eccentric rollers limiting rollers are situated which have a small interspace "d" with respect to the eccentric rollers, and that the forked mountings which are movable in three dimensions are connected at their upper flattened ends to pads made of an elastic, resilient material, and that the supporting plates are supported on these pads and as a result of this mounting can be moved by limited amounts on account of the additional degree of freedom thus provided in the transverse direction and in their longitudinal direction.

3. Device according to claim 1, characterized in that each of the first and second table-like supporting plates is positioned at both its end regions on forked mountings, each of which is movable in three dimensions and which accommodates bearings for both ends of axle shafts of eccentric rollers, and that the eccentric rollers are supported on one side by drive rollers and on the other side by support rollers, and that the double-ended drive rollers are set in synchronous or asynchronous rotational motion, in the same or different directions, by at least one motorized drive, and that above the eccentric rollers limiting rollers are situated which have a small interspace "d" with respect to the eccentric rollers, and that the forked mountings which are movable in three dimensions have an articulated joint connection to the supporting plates, which as a result of this mounting can be moved by limited amounts on account of the additional degree of freedom thus provided in the transverse direction and in their longitudinal direction.

4. Device according to claim 1, characterized in that each of the first and second table-like supporting plates is positioned at both its end regions on forked mountings, each of which is movable in three dimensions and which accommodates bearings for both ends of axle shafts of eccentric rollers, and that the eccentric rollers are supported on one side by drive rollers and on the other side by support rollers, and that the double-ended drive rollers are set in synchronous or asynchronous rotational motion, in the same or different directions, by at least one motorized drive, and that above the eccentric rollers limiting rollers are situated which have a small interspace "d" with respect to the eccentric rollers, and that the forked mountings which are movable in three dimensions are connected to the supporting plates in which rollers or cylindrical roller bearings are guided which are connected to the mountings by bearing journals, by which the supporting plates may be longitudinally moved by limited amounts with respect to the mountings.

5. Device according to claim 1, characterized in that each of the first and second table-like supporting plates is positioned at both its end regions on forked mountings, each of which is movable in three dimensions and which accommodates bearings for both ends of axle shafts of eccentric rollers, and that the eccentric rollers are supported on one side by drive rollers and on the other side by support rollers, and that the double-ended drive rollers are set in synchronous or asynchronous rotational motion, in the same or different directions, by at least one motorized drive, and that above the eccentric rollers limiting rollers are situated which have a small interspace "d" with respect to the eccentric rollers, and that the forked mountings which are movable in three dimensions are connected to the supporting plates, to which longitudinal tilting axles extending in the "x" axis are fastened and upon which cover plates are mounted by means of axle blocks so as to be tiltable in the transverse direction.

6. Device according to claim 5, characterized in that the mobility of the cover plates on the supporting plates may be limited or eliminated by slider bars that are movable on the supporting plates in conjunction with the adjusting screws when the slider bars are moved in the direction of the cover plates and totally or partially fixed in place by a positioning slot or by ramp-shaped inclined surfaces of sliding pieces that are oppositely directed on the cover plates.

7. Device according to claim 1, characterized in that each of the first and second table-like supporting plates is positioned at both its end regions on forked mountings, each of which is movable in three dimensions and which accommodates bearings for both ends of axle shafts of eccentric rollers, and that the eccentric rollers are supported on one side by drive rollers and on the other side by support rollers, and that the double-ended drive rollers are set in synchronous or asynchronous rotational motion, in the same or different directions, by at least one motorized drive, and that above the eccentric rollers limiting rollers are situated which have a small interspace "d" with respect to the eccentric rollers, and that the forked mountings which are movable in three dimensions are connected to the supporting plates, to which longitudinal hinges extending in the x axis are fastened and upon which cover plates are mounted by means of composite pieces so as to be tiltable in the transverse direction.

8. Device according to claim 1, characterized in that cover plates are connected to the supporting plates.

9. Device according to claim 8, characterized in that the cover plates are connected to the supporting plate by means of bearing blocks which are joined to the supporting plate by screws.

10. Device according to claim 8, characterized in that the cover plates are mounted on an elastic intermediate bearing disk by screw bolts in the respective central surface area of the supporting plates so as to enable slight movement in three dimensions, the mobility of same in the transverse and longitudinal directions being limited by stationary positioning bolts which engage in sickle-shaped slits present in the cover plates.

11. Device according to claim 1, characterized in that the eccentric rollers have a convex shell surface with a degree of convexity between 1.00 mm and 10.00 mm.

12. Device according to claim 1, characterized in that the limiting rollers have a convex shell surface with a degree of convexity between 1.00 mm and 10.00 mm.

* * * * *